United States Patent [19]

Sewell et al.

[11] Patent Number: 4,739,836

[45] Date of Patent: Apr. 26, 1988

[54] ARRANGEMENT FOR USE IN SURFACE TREATMENT

[76] Inventors: Michael J. B. Sewell; Stephen C. B. Sewell; Christopher K. B. Sewell; Charles P. B. Sewell; Margaret I. Sewell, all of 82 Cliffview Drive, Green Bay, Auckland, New Zealand

[21] Appl. No.: 709,530

[22] Filed: Mar. 8, 1985

[30] Foreign Application Priority Data

Mar. 11, 1984 [NZ] New Zealand ..... 207387

[51] Int. Cl.[4] ..... E21B 1/00

[52] U.S. Cl. ..... 173/50; 15/49 RB

[58] Field of Search ..... 173/50, 51; 15/47 RB, 15/380, 50 A

[56] References Cited

U.S. PATENT DOCUMENTS

| | | | |
|---|---|---|---|
| 2,728,000 | 12/1955 | Marchand | 15/49 RB |
| 4,138,764 | 2/1979 | Eschenbach et al. | 15/49 RB |

FOREIGN PATENT DOCUMENTS

| | | | |
|---|---|---|---|
| 517599 | 2/1931 | Fed. Rep. of Germany | 15/49 RB |
| 636245 | 4/1928 | France | 15/49 RB |
| 185887 | 8/1936 | Switzerland | 15/49 RB |

*Primary Examiner*—E. R. Kazenske
*Assistant Examiner*—Willmon Fridie, Jr.
*Attorney, Agent, or Firm*—Ladas & Parry

[57] ABSTRACT

The present invention relates to an arrangement for use in surface treatment. The arrangement includes at least two elongate operating members, the underside of the operating members either being formed to allow for surface treatment or having attached thereto material to facilitate surface treatment. The operating members are so mounted as to be capable of longitudinal movement, relative one to another. Drive means are provided which impart a longitudinal, reciprocal moment to each of the operating members. At least one handle or grip member is provided for use by an operator. On actuation, the drive means impart longitudinal, reciprocal moments to the elongate operating members, the undersides of which are applied to a surface to be treated.

5 Claims, 3 Drawing Sheets

ARRANGEMENT FOR USE IN SURFACE TREATMENT

BACKGROUND TO THE INVENTION

This invention relates to an arrangement or apparatus for use in the treatment of surfaces.

Throughout the specification and claims, the term "surface treatment" is used. This term is used to refer to the treatment of any appropriate surface, such as for example by coating, abrading, cutting, brushing, polishing buffing and the like. These are by way of example only however. Such treatment can be applied to any and all appropriate surfaces, such as for example wood, synthetic and natural resins, resin bonded materials, cement, ferro cement, earthenware, wallboards, chip board, plaster board, fibreboard, metal and the like. Again these are by way of example only. The invention has application to all surfaces.

Up until this time, various arrangements and means have been provided for the treatment of surfaces and for the preparation of surfaces for varying purposes. For example, arrangements and implements have been provided for sanding down wooden surfaces, to provide a smooth surface, prior to painting or varnishing. Arrangements and implements have also been provided which smooth down roughened surfaces, in order to avoid rough and unpleasant surfaces which can be displeasing from an aesthetic point of view and capable of causing injury or damage.

It has also been known up until this time to provide various arrangements for obtaining a smooth or fair line or clean surface, or indeed a convex or concave surface, (such as is required on marine craft).

The methods and arrangements for surface treatment, used up until this time, have often involved the use of implements or machines, employing a basically rotary, orbital or continuous belt action.

Referring in particular to situations where is has been desired to prepare and finish round or curved surfaces, (such as for example during the construction of marine craft), initial preparation is usually carried out by such known methods and apparatus, with finishing usually being carried out by hand. The finishing is therefore often carried out by one or more operators, using sand paper or sand paper connected to a base board.

While many of these known methods and arrangements have been reasonably satisfactory for many purposes, there have also been a number of disadvantages, in that in particular the requirement for hand finishing (which is nearly always necessary), always involves substantial time and effort from a labour point of view. In particular, this applies when finishing curved surfaces. It has been found to be a particular problem with marine craft, and in particular boat hulls. This applies in particular to relatively small boats, where it is very important that a fair line be achieved from bow to stern; from top side to keel and on the diagonals. Indeed it is important that a fair line be obtained in all directions, so that not only is the hull of the boat aesthetically pleasing, but so that water flow is aided and effectively permitted around the hull of a marine craft. As will be appreciated, this minimises water resistance and therefore provides for maximum hull performance.

Up until this time, when finishing boat hulls, it has been the general practice to remove most of the severe irregularities on the surface, (such as high spots), by the use of known methods and machines; such as for example rotary, orbital and continuous belt action arrangements. A fair line has then been obtained by using hand sanders or similar hand operated arrangements. As will be appreciated, this is particularly time consuming and expensive.

For example, in a number of cases, hand powered sanding boards have been used, these including a basic board or support arrangement which has sand paper or similar abrasive material attached thereto. These hand operated boards are gripped by an operator and are merely moved backwards and forwards manually. Eventually, the appropriate and necessary fair line is achieved.

It will be appreciated however, that such hand operation is hard, tedious and particularly time consuming work. In some cases, and depending of course upon the size of the marine craft concerned, it may require months of hand fairing or hand sanding, to obtain an acceptable and satisfactory fair line and standard of finish. This is particularly so where it is necessry to finish a high class or high performance, hand constructed marine craft.

Reference is made by way of example only, to the problems encountered in the preparation of marine craft and boats. However, it should be appreciated that similar problems arise in other areas, such as for example building construction areas, and in the area relating to the preparation of moulds and plugs, (such as for use in the production of boat hulls, swimming pools, saunas and the like). In addition, the shortcomings also exist in the automotive panelbeating business, where for example soft plastics or soft metal fillers are used to fill dents and damaged portions of panelwork. Following this filling, the surfaces must be abraded or cut back to produce fair curves or a fair line, relative to the undamaged portion of the panels or panels, of the body of the automobile.

Thus, it will be appreciated that once again, an amount of hand and manual work is required, which as stated above, is hard, tedious and time consuming.

A further problem with methods and arrangements used up until this time, is that they have been unable to satisfactorily conform to desired surface shapes of materials, being finished, and thus cannot be satisfactorily used for sanding or preparing surfaces for painting, varnishing and other finishes.

In addition to the above, rotary sanders and surface grinders (and to a certain extent orbital sanders), operate with such an action that when using a coarse grit, or even a moderately coarse grit or abrasive surface, the surface being treated is often marred with scour marks, such as for example circular scour marks. Even though it may be possible to remove these with a good hand finish, such scour marks often require a substantial amount of hand sanding or hand work before they are effectively removed.

Orbital sanders used up until this time cannot, it has been found, operate hard up against any projecting surface. For example, against curves or angels at an overlap point in any horizontal weatherboard sheeting of a house, or even in a vertical board and batten sheathing. The action of an orbital sander causes banging and often action against projecting surfaces, and sometimes denting or damaging of the projecting surfaces.

Belt sanders have been used up until this time in certain areas of surface treatment. Such arrangements have not normally been capable of being used for sanding or treatment, hard up against any projection, as the belts usually run centrally over rollers and an intermediate platten. In models which have been designed and manufactured to allow relatively close sanding, this is often restricted to one side of the machine. In the case of sanding such surfaces of vertical board and batten walls, using belt sanders, this would require the machine to be reversed. Thus, in such cases, the contact surface of the sand paper or abrasive belt, would tend to drive the machine downward. This then requires some degree of strength to allow sufficient control or operation, which is particularly tiring from an operators point of view. In certain belt sanders used up until this time, it has also been a problem that the belts sometimes become dislodged and removed from the rollers and plattens, this causing delays and in some cases damage. Further problem with belt sanders used up until this time, is that sanding work (and thus surface treatment) effectively only takes place under the central platten and not under the end rollers. Thus, it is not possible with belt sanders known up until this time, to effectively and fully sand into corners and similar locations.

Problems have also been encountered with known arrangements used for cleaning, polishng, buffing and the like.

It will be appreciated from the above that there are a number of known methods and arrangements for use in surface treatment. It will also be appreciated however that there are a number of problems associated therewith.

It is an object of this invention to go at least some way towards overcoming or minimising one or more of these problems.

It is a further object of the invention to provide a straight forward and efficient arrangement for surface treatment.

SUMMARY OF THE INVENTION

According to one aspect of this invention there is provided an arrangement for use in surface treatment, including at least two elongate operating members so mounted as to be capable of longitudinal movement, relative one to another; drive means being provided and being so adapted as to impart a longitudinal, reciprocal, moment to each of said operating members; and further including at least one handle or grip member.

According to a further aspect of this invention there is provided an arrangement for use in surface treatment, including at least two elongate and laterally spaced apart operating members, which are so mounted as to be capable of longitudinal movement, relative one to another; drive means and at least one handle or grip member being provided at or adjacent a first end of said elongate operating members; said drive means being adapted to impart a longitudinal, reciprocal moment to each of said operating members; a pivotally mounted connecting plate extending between said elongate operating members, at or adjacent a second end thereof; a handle or grip member being pivotally mounted to said connecting plate.

According to a further aspect of this invention there is provided an arrangement for use in surface treatment, including at least two laterally spaced apart, elongate, operating members, so mounted as to be capable of longitudinal movement, relative one to another; drive means being provided and being so adapted as to impart a longitudinal reciprocal moment to each of said operating members; and further including at least one handle or grip member; said drive means including upper and lower, substantially co-axial, drive shafts, which extend outwardly of a prime mover adapted to impart alternate, longitudinal, reciprocating moments, to each of said drive shafts; said drive shafts being positioned between laterally spaced apart mounting plates, which detachably mount said elongate operating members; lateral links extending outwardly from opposite sides of each of said drive shafts; said links being connectable to separate mounting plates on respective sides of said drive shafts; the drive shafts being positioned between upper and lower carrier shafts which extend from said prime mover to a position substantially between said mounting plates; one or more elongate slots being provided in said drive shafts; securing means passing through said carrier shafts and through the elongate slots in said drive shafts, so as to hold the carrier shafts and drive shafts in substantial juxtaposition relative to each other; the arrangement being such that on actuation of said prime mover, an alternate, reciprocal, longitudinal moment is applied to each of said drive shafts, said reciprocating moments thereafter being imparted to respective mounting plates and elongate operating members.

BRIEF DESCRIPTION OF THE DRAWINGS

The invention will now be described with reference to the accompanying drawings wherein.

DETAILED DESCRIPTION OF THE PREFERRED EMBODIMENT

Figure 1:
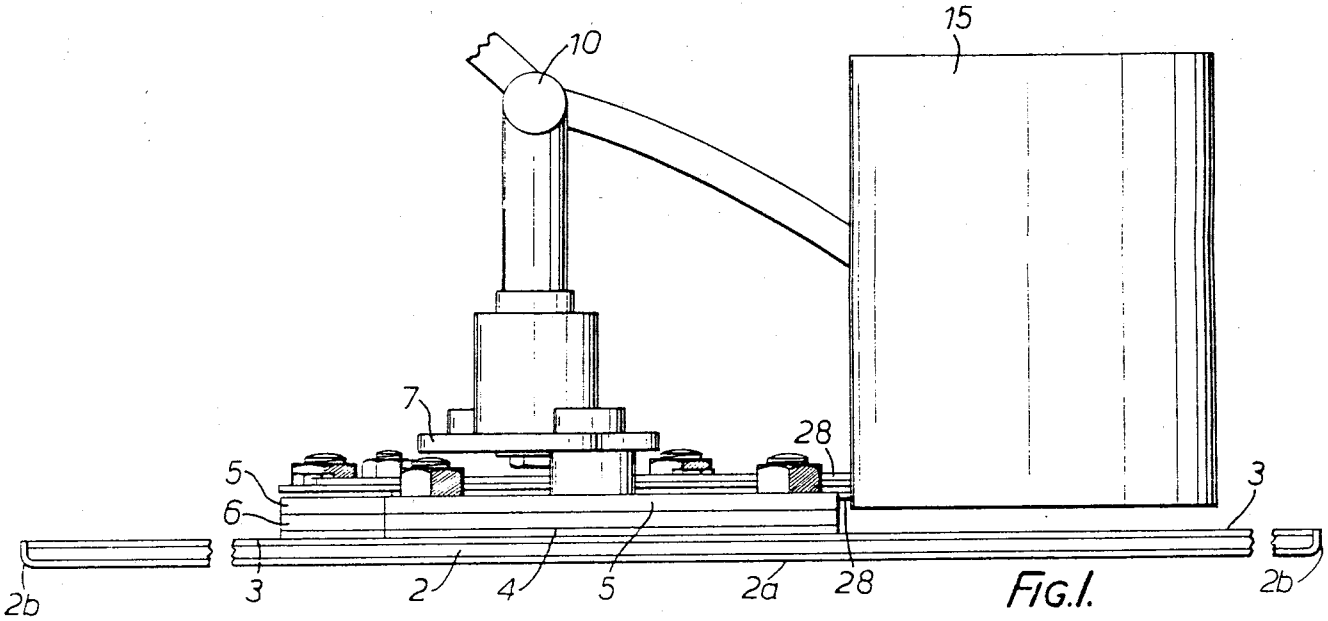
FIG. 1 is a side view of an arrangement according to one form of the present invention.

It will be appreciated from the above, that there are a number of problems associated with methods and arrangements used for surface treatment up until this time.

The present invention effectively sets out to overcome or minimise one or more of these problem, by providing an arrangement which includes at least two elongate operating members, formed of an appropriate material, the underside of the operating members either being formed to allow for surface treatment, or having attached thereto, material to facilitate surface treatment. The elongate operating members are connected to one another, in a basically "side by side" manner, and are associated with a prime mover and drive means. The prime mover and drive means are so adapted, such that on operation of the prime mover the drive means imparts an alternate reciprocating moment to each of the operating members, such that they reciprocate in a longitudinal axis, relative to each other. It has been found that this reciprocating movement of the operating members relative to each other, provides for particularly effective, controlled and straight forward surface treatment. In particular the reciprocal movement of the operating members of the present invention (as will be appreciated from the following description), provides an effective means of providing a good surface finish and fair line. The present invention also provides an arrangement whereby the alternating reciprocal movements of the operating members compensate for each other to a certain extent this at least reducing the effort required on the part of the operator(s).

The arrangement of the present invention includes at least two elongate operating members 2, in the form of elongate lengths of suitable material, such as wood, fibreglass, metal, synthetic resin or some other suitable or appropriate material. The underside surfaces 2*a* of the operating members 2 have attached thereto an appropriate surface or configuration, or have integrally attached thereto or formed therewith, a desired surface or configuration. For example, the undersides 2*a* of the operating members 2 have matter attached thereto, or are so formed, as to allow for sanding, polishing, buffing, abrading, cutting or the like. For example a suitable roughened sand paper or abrasive type material can be attached to the undersides 2*a* of the operating members 2, for use in the sanding of an appropriate surface. It will be appreciated however, that this is by way of example only, and that the underside surfaces of the operating members can be formed of any desired configuration or contour, or can have any appropriate material or surface attached thereto, depending upon the desires of the user.

The operating members 2 can be essentially straight or flat members, or alternatively can be curved or tensioned (in particular where it is desired to use the arrangment of the present invention, for the treatment of curved or generally rounded surfaces). It is particularly advantageous although not essential, that the operating members be either tensioned, and at least partially curved, or so constructed of an appropriate material that they have at least some inherent resilience and flexibility, when in use.

In a preferred form of the invention, the operating members 2 are constructed of a material which is at least semi-flexible or resilient. It will be appreciated that this is not an essential feature of the invention, but does allow for the operating members to conform to predetermined shapes, configurations and contours.

In preferred forms of the invention, two spaced apart elongate operating members 2 are provided, the operating members being laterally spaced apart for a short distance, one from the other, and as will be appreciated hereinafter, means are provided to connect the operating members 2 together, in an essentially spaced apart manner.

In a further form of the invention (not shown), at least two side by side elongate operating members 2 are used, the adjacent sides thereof, being effectively "stepped" so that they engage with each other in a "stepped" manner, this allowing for the lateral meshing of the operating members 2, while at the same time allowing for longitudinal movement therebetween, and relative thereto.

While the present invention is described with reference to the use of two elongate operating members 2, it should be appreciated that the invention has application to more than two operating members. For example three, four or a plurality thereof.

In one form of the present invention, as shown in FIG. 1 of the accompanying drawings, the arrangement is adapted to be capable of being used by a single operator.

Referring therefore to FIG. 1 of the drawings, two spaced apart elongated operating members 2 are provided, these being provided with an appropriate treatment surface 2*a* on the underside thereof. Intermediate the free ends 2*b* of the elongate operating members 2, an arrangement is provided which allows for the operating members 2 to be effectively maintained in a reciprocating side by side position, while at the same time allowing for a reciprocating moment to be imparted to each of the elongate operating members 2.

In one form of the invention, an appropriate mounting block 4 can be provided on upper surfaces 3, of each of the operating members 2, at a predetermined or desired position intermediate the free ends 2*b*. Appropriate attachment means such as screws, bolts or the like, extend upwardly therefrom, so as to allow for engagement with mounting plates 5. This will be described hereinafter. In an alternative form of the invention an appropriate over-centre catch means can be provided on an upper surface 3 of the operating members 2, so as to allow for a quick and effective releaseable engagement between the mounting plates and the upper surfaces of the operating members. Other releaseable engagement means and arrangements can be used.

If desired, an appropriate shock absorbing material 6 such as a flexible or semi-flexible shock absorbing material can be provided between mounting blocks 4 or upper surfaces 3 of the operating members 2, and an underside of the mounting plates 5, in order to assist in absorbing vibration and the like, brought about by the reciprocal moment being applied to the operating members 2, and as will be appreciated further hereinafter.

In the form of the invention shown in FIG. 1 of the drawings, mountng blocks 4 can be provided in an appropriate manner on upper surfaces 3 of the laterally spaced apart operating members 2, in any appropriate manner; with, for example, engagement means in the form of screws or bolts extending upwardly therefrom. Mounting plates 5 with holes provided therein, are then positioned over the blocks 4 so that the upwardly extending bolts or the like, engage within the holes in the mounting plates, these then being secured in position such as by nuts and the like. Other means of attachment including releaseable attachments, can however be used. Thus, mounting plates 5 are releaseably or detachably engaged with or mounted relative to, elongate members 2. It is an advantage of the present invention, that the operating members are, in one form, releaseably engageable. Thus, it will be appreciated that operating members can therefore be removed for repair or replacement as desired. For example, various sizes, shapes, and surfaces can be replaced and modified because of the releasable or replaceable nature of the engagement of the mounting plates 5 and the operating members 2.

An elongate connecting plate 7 extends between and over the mounting plates 5, and is pivotally connected to each of the mounting plates 5, while being maintained in a spaced apart position above the mounting plates. The connecting plate 7 is pivotally connected to the mounting plates as at 8 and 9 so as to allow for its pivotal movement, on a reciprocating movement being applied to each of the operating members 2.

A handle or grip member 10 extends upwardly from the connecting plate 7 to enable the arrangement of the invention to be held and gripped by an operator. In a preferred form of the invention, an operating switch 10a or mechanism is associated with the handle to enable an operator to control the operation of the arrangement. For easy and straight forward operation and for control of the arrangement of the invention, the handle 10 is pivotally mounted to the connecting plate 7.

The connecting plate 7 serves to maintain the elongate operating members 2 in a spaced apart yet substantially parallel position relative to each other.

A prime mover 15, such as for example an electric motor or some other appropriate prime mover is provided and mounted so as to be adjacent to the mounting plates 5.

In the form of the invention shown in FIG. 1 of the drawings, the prime mover 15 is in the form of an appropriate electrical motor, connected by a flex or cord 16 to a source of power. Other forms of prime mover can however be used, as will be described hereinafter.

The prime mover 15 preferably operates drive means which impart a reciprocating moment to each of the operating members 2.

In the form of the invention shown in FIG. 1 of the drawings, drive means extend outwardly from the prime mover, the drive means being in the form of at least two elongate shafts 18 and 19, which extend from the prime mover 15 and are also connected to respective mounting plates.

Figure 2:
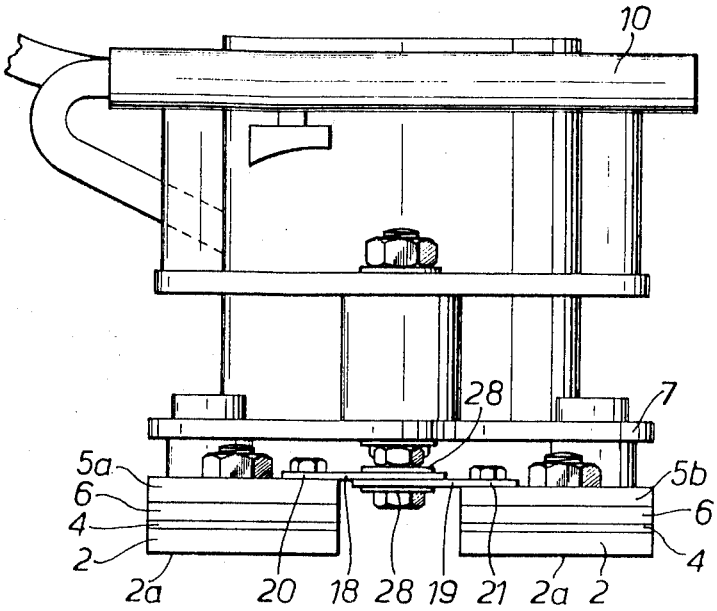
FIG. 2 is an end view of an arrangement according to one form of the present invention.

The elongate drive shafts 18 and 19 are substantially flat shafts in one form of the invention, and are substantially co-axial, being positioned one on top of the other, the shafts, being so mounted to the prime mover 15, that on actuation of the prime mover 15, the drive means is caused to reciprocate each of the shafts 18, 19 alternatively. Link members 20, 21 are provided which extend outwardly and substantially transversely of the longitudinal axes of the shafts 18,19 so that in a preferred form of the invention the links 20 extending outwardly and transversely from the upper or top elongate shaft 18 are suitably connected or attached to the mounting plate 5*a*, while the links 21, extending outwardly from the bottom or lower elongate shaft 19 are attached to the mounting plate 5*b*, (FIG. 2 of the drawings).

Carrier means are provided for mounting the prime mover 15, the carrier means being in the form of elongate carrier shafts 28 which extend outwardly from the prime mover, and are positioned immediately above and below (and substantially co-axial with) the drive shafts 18, 19.

The drive shafts 18, 19 preferably have elongate slots 27 therein, and suitable securing means such as bolts, screws and the like are passed through the upper and lower carrier shafts 28 and through the slots in the drive shafts 18, 19 to be secured in this position. In this way, the carrier means 28 and drive means 18, 19 are secured one to the other, the carrier means 28 preferably being formed of a relatively rigid or strong material, which allows the prime mover to be thereby supported relative to the mounting plates 5.

Thus, in use, once the prime mover 15 is actuated (by for example operation of a switch or operating means on a handle), the drive shafts 18, 19 will be caused to reciprocate in an alternate manner, the drive shafts 18,19 reciprocating in the path defined by the spaced apart carrier shafts 28, this being possible due to the elongate slots in the drive shafts 18, 19. The alternate reciprocating moments being applied to the drive shafts 18, 19 are in turn imparted to the mounting plates 5 attached to the operating members 2, through the links 20, and 21.

Thus, on actuation of the prime mover 15, the operating members 2 are caused to alternately reciprocate in a substantially longitudinal direction so as to be applied against a surface to be treated.

Figure 4:
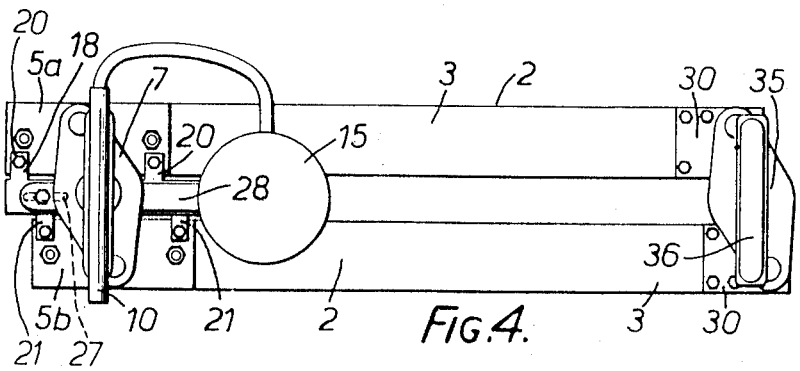
FIG. 4 is a plan view of an arrangement of of the present invention.
Figure 3:
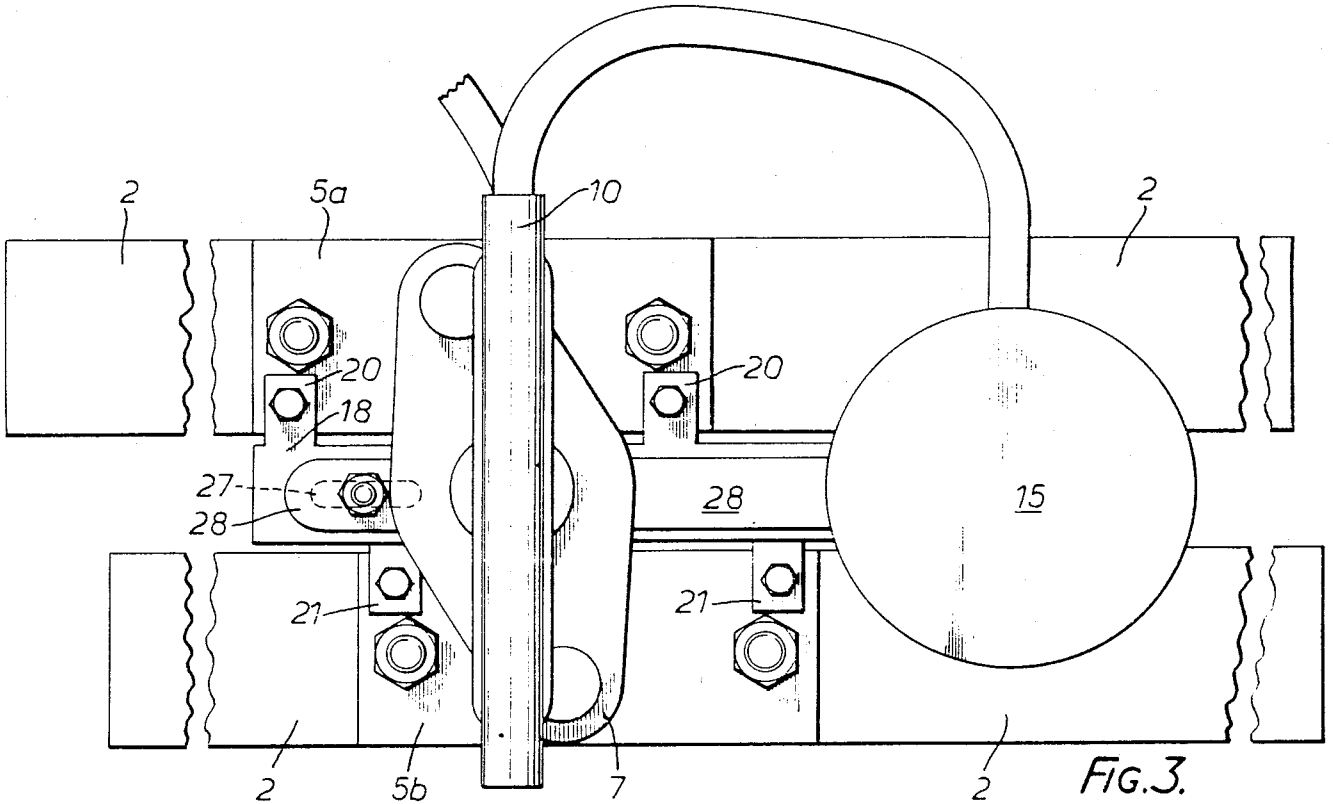
FIG. 3 is a plan view of an arrangement of one form of the present invention.

In a further form of the invention as shown in FIG. 4 of the accompanying drawings, the elongate operating members 2 are laterally spaced apart one from the other, but the mounting plates 5 and prime mover 15 are provided adjacent one end thereof, rather than between or substantially intermediate the ends thereof. At or adjacent the other end of the operating members 2, mounting plates 30 are provided and are attached to the upper surfaces 3 of the operating members 2, a connecting plate 35 spanning the mounting plates 30 and being pivotally connected thereto, so as to connect the free ends together in a basically spaced apart manner, so as to allow for the reciprocal movement of the operating members 2 relative to each other.

A handle or grip 36 is also preferably provided at the other end of the operating members 2, which is pivotally connected to, and extends upwardly from, the connector plate 35, so that an operator can use the arrangement by gripping both spaced apart ends, (for example when treating a greater or curving surface). Alternatively, the arrangement can be used by being gripped or held at each end by a separate operator. This would be particularly advantaged, where the elongate operating members are of relatively substantial length and where for example the surface is arcuate or curved, this also requiring flexible pre-tensioned and/or curved operating members 2. In use, on certain surfaces and in certain circumstances, it may be that the reciprocal movement of the operating members 2 will cause a slight "scissors" effect, such that it is desirable to form or modify the mountings to allow for and accommodate such movement. Thus, for example mountings can be provided with elongate slots so that the operating members can be maintained in a substantially side by side relationship notwithstanding the movement thereof.

It should be appreciated that the reciprocal movement or moment being applied to the operating members, is such that a vibratory moment is, in many circumstances, also applied to the operating members.

We have described forms of the present invention with reference to the prime mover 15 being in the form of an electrical motor, but it should be appreciated that the prime mover can be of any appropriate form. For example, the prime mover and drive means can be operated by means of pneumatics, air pressure cylinders, hydraulics, internal combustion, steam, magnetic drive, spring return mechanisms or the like.

In some forms of the invention it is considered that it may be desirable, (in order to assist maintaining contact between the undersides of the operating members and a surface to be treated), to use one or more weights (not shown) along the length of one or more operating members 2. For example, these can be clipped on, secured in any desired manner or attached by magnetic means and the like. Alternatively, magnetic, gaseous or air pressure force or weight could be applied in order to assist in maintaining the operating members against a surface to be treated. It will be appreciated that in certain circumstances, it may be particularly advantageous to apply such weight, given that a continuity of pressure throughout the length of the operating member, during a sanding or buffing operation, is important to an effective operation and satisfactory end result.

The present invention has been described by way of example only and with reference to the accompanying drawings in connection with two spaced apart elongate operating members. As referred to hereinbefore, this is by way of example only however, and a greater number of operating members can be used if desired.

We claim:

1. An arrangement for use in surface treatment, comprising: two elongate operating members, a plurality of mounting plates, two connecting plates, drive means, and two handle members; each of said operating members being configured and mounted to permit conformity to predetermined surface conditions to be treated; wherein said operating members are laterally spaced apart one from another, at least one mounting plate is attached to each end of each of said operating members, one of said connecting plates is located at a first end of said operating members and another of said connecting plates is located at a second end of said operating members, each of said connecting plates extending between said operating members, each of said connecting plates being pivotally connected to said mounting plates on said first or second end of said operating members, said operating members being so mounted as to be capable of longitudinal, reciprocating movement relative to one another; and wherein said drive means and one of said handle members is provided adjacent to said first end of said operating members, and one of said handle members is provided adjacent said second end of said operating member; said drive means including at least two elongate drive shafts, each drive shaft being connected to a separately mounted plate and being adapted to have a reciprocating movement applied thereto, and a prime mover being provided to impart said reciprocating moments to said drive shafts.

2. An arrangement as claimed in claim 1, wherein at least one of said handle members is pivotally connected to said connecting plate.

3. An arrangement as claimed in claim 1, including releasably mounted elongated operating members.

4. An arrangement as claimed in claim 1, wherein said drive means include upper and lower, substantially coaxial, drive shafts; said drive shafts extending outwardly from a prime mover which is adapted to impart a reciprocating moment, to each of said drive shafts; said drive shafts being located between mounting plates; lateral links extending outwardly from opposite sides of each drive shaft and being connectable to separate mounting plates on respective sides thereof; the drive shafts being positioned between upper and lower carrier shafts which extend from said prime mover to a position substantially between said mounting plates; one or more elongate slots being provided in said drive shafts; securing means passing through said carrier shafts and said drive shafts so as to hold the carrier shafts and drive shafts in juxtaposition relative to each other; the arrangement being such that on actuation of said prime mover, an alternate, reciprocal, longitudinal moment, is applied to each of said drive shafts, and through said links to respective mounting plates and elongate operating members mounted thereto.

5. An arrangement as claimed in claim 1, wherein said elongate operating members are formed with means on the underside thereof to allow for preselected surface treatment dependent on conditions and configurations of said surface to be treated.

* * * * *